US005135788A

United States Patent [19]

Nolte

[11] Patent Number: 5,135,788

[45] Date of Patent: Aug. 4, 1992

[54] FIREPROOF BLASTING ASSEMBLY FOR GLASS PANE

[75] Inventor: Hans-Henning Nolte, Gelsenkirchen, Fed. Rep. of Germany

[73] Assignee: Flachglas Aktiengesellschaft, Furth, Fed. Rep. of Germany

[21] Appl. No.: 530,550

[22] Filed: May 29, 1990

[30] Foreign Application Priority Data

Jun. 3, 1989 [DE] Fed. Rep. of Germany ..... 3918158

[51] Int. Cl.[5] ..... E06B 5/16

[52] U.S. Cl. ..... 428/38; 52/171; 52/208; 52/824; 49/501; 49/DIG. 1; 428/34; 428/38; 428/99; 428/83; 428/137; 428/1

[58] Field of Search ..... 428/34, 38, 99, 83, 428/137, 138, 139, 140, 192, 255, 448, 450, 920, 921; 52/171, 208, 824; 49/501, DIG. 1

[56] References Cited

U.S. PATENT DOCUMENTS

| | | | |
|---|---|---|---|
| 2,683,678 | 7/1954 | Adams | 52/208 |
| 3,098,698 | 7/1963 | Glynn | 49/501 X |
| 3,204,324 | 9/1965 | Nilsen | 49/DIG. 1 X |
| 3,212,179 | 10/1965 | Koblensky | 49/DIG. 2 X |
| 3,214,212 | 10/1965 | Horton | 428/140 X |
| 4,118,266 | 10/1978 | Kerr | 49/DIG. 1 X |
| 4,240,235 | 12/1980 | Nawa | 49/501 X |
| 4,364,209 | 12/1982 | Gebhard | 52/208 |
| 4,447,985 | 5/1984 | Weber et al. | 49/501 X |
| 4,811,529 | 3/1989 | Harris et al. | 428/920 X |
| 4,866,895 | 9/1989 | Hlavaty | 52/208 |

FOREIGN PATENT DOCUMENTS

| | | |
|---|---|---|
| 2328737 | 10/1975 | Fed. Rep. of Germany . |
| 3140785 | 4/1983 | Fed. Rep. of Germany . |

*Primary Examiner*—Ellis P. Robinson
*Assistant Examiner*—William P. Watkins, III
*Attorney, Agent, or Firm*—Herbert Dubno; Andrew Wilford

[57] ABSTRACT

A glass pane has a pair of opposite faces and an outer edge and is held in a structural channel forming a groove by an adapter. The adapter is formed in part by respective metallic edge strips each having an inner portion overlying a respective face of the pane and an outer portion projecting outward therefrom and into the groove. The outer edge of the pane is spaced from the channel and lies wholly outside the groove. Inner portions of the strips are secured to the respective faces of the pane and a nonmetallic bar is secured between the outer portions of the edge strips and engaged in the groove. The strips are secured to the glass by an adhesive and each strip includes a perforate under strip adhered to the glass and an imperforate cover strip adhered atop the under strip. The adhesive has a silicone or water-glass base and is quite resistant to heat.

11 Claims, 1 Drawing Sheet

FIREPROOF BLASTING ASSEMBLY FOR GLASS PANE

FIELD OF THE INVENTION

The present invention relates to mounting a glass pane. More particularly this invention concerns a fire-resistant mounting assembly for a glass pane.

BACKGROUND OF THE INVENTION

A pane of glass is normally mounted in firecode construction in a fire-resistant frame, typically of metal. The outer edge of the glass pane is fitted into a channel of the frame. As described in German patent 2,328,737 filed Jun. 6, 1973 by G. Ortmanns and in German patent document 3,140,785 filed Oct. 14, 1981 by G. Leyens et al, it is standard to interpose a layer of heat-resistant insulation material in the channel on at least one side of the pane, normally on the so-called cold side which is that side on which fire is less likely. The insulation layer prevents the glass pane from pulling out of the frame.

Such an arrangement is only effective for relatively short-duration fires. When, however, the pane is exposed to a fire for a much longer period, for instance 60 min, the glass pane deforms at its edges and comes at least partially out of the channel holding its outer edge.

OBJECTS OF THE INVENTION

It is therefore an object of the present invention to provide an improved mounting assembly for a glass pane.

Another object is the provision of such an improved mounting assembly for a glass pane which overcomes the above-given disadvantages, that is which is capable of resisting considerable heat for a very long time.

SUMMARY OF THE INVENTION

A glass pane according to this invention has a pair of opposite faces and an outer edge and is held in a structural channel forming a groove by an adapter. The adapter is formed in part by respective metallic edge strips each having an inner portion overlying a respective face of the pane and an outer portion projecting outwardly therepast and into the groove. The outer edge of the pane is spaced form the channel and lies wholly outside the groove. Inner portions of the strips are secured adhesively to the respective faces of the pane and a nonmetallic bar is secured between the outer portions of the edge strips and engaged in the groove.

According to this invention each strip includes a perforate under strip adhered to the glass and an imperforate cover strip adhered atop the under strip. Preferably the adhesive has a silicone or water-glass base and is quite resistant to heat. Finely divided metallic particles having good heat-conducting properties can be mixed with the adhesive. Multicomponent glues needing no drying are preferred.

Thus the glass is separated somewhat from the metallic frame so that it will not be directly heated by it. It will be able to stand considerable heat for quite some time before softening and separating from the frame. There is therefore no significant temperature gradient between the temperature of the glass pane and its edges. The adapter serves as a temperature equalizer. It also has a mechanical function to prevent stresses caused by temperature differentials from being effective to spring the glass from its frame. The adapter itself solidly connects the pane to the frame since on its inner side the adapter is fixed to the pane and on its outer side it is solidly set in the frame.

In accordance with this invention the outer edge is spaced outward from the channel and the bar has an inner edge lying outside the groove. The outer edge of the pane and inner edge of the bar are spaced apart and separated by an air gap and respective layers of insulation lie between the outer portions of the strips and confronting faces of the groove. The air gap is of a size about equal to about half the thickness of the glass pane.

The understrips at least are normally made of steel, preferably of expanded metal. These strips have surfaces turned toward the respective faces of the pane and provided with projections holding them off the faces so that the adhesive fills interstices between the projections. The under strips at least can be made of wire mesh also and the cover strips can be of metal and less than 1 mm thick. Such a cover strip protects the underlying strip from direct contact with flames, but is so thin that it conduct only insignificant amounts of heat.

The pane according to this invention is a single-sheet safety glass, a borosilicate glass, or an aluminosilicate glass. The bar is of calcium silicate.

DESCRIPTION OF THE DRAWING

The above and other objects, features, and advantages will become more readily apparent from the following, reference being made to the accompanying drawing in which.

SPECIFIC DESCRIPTION

Figure 2:
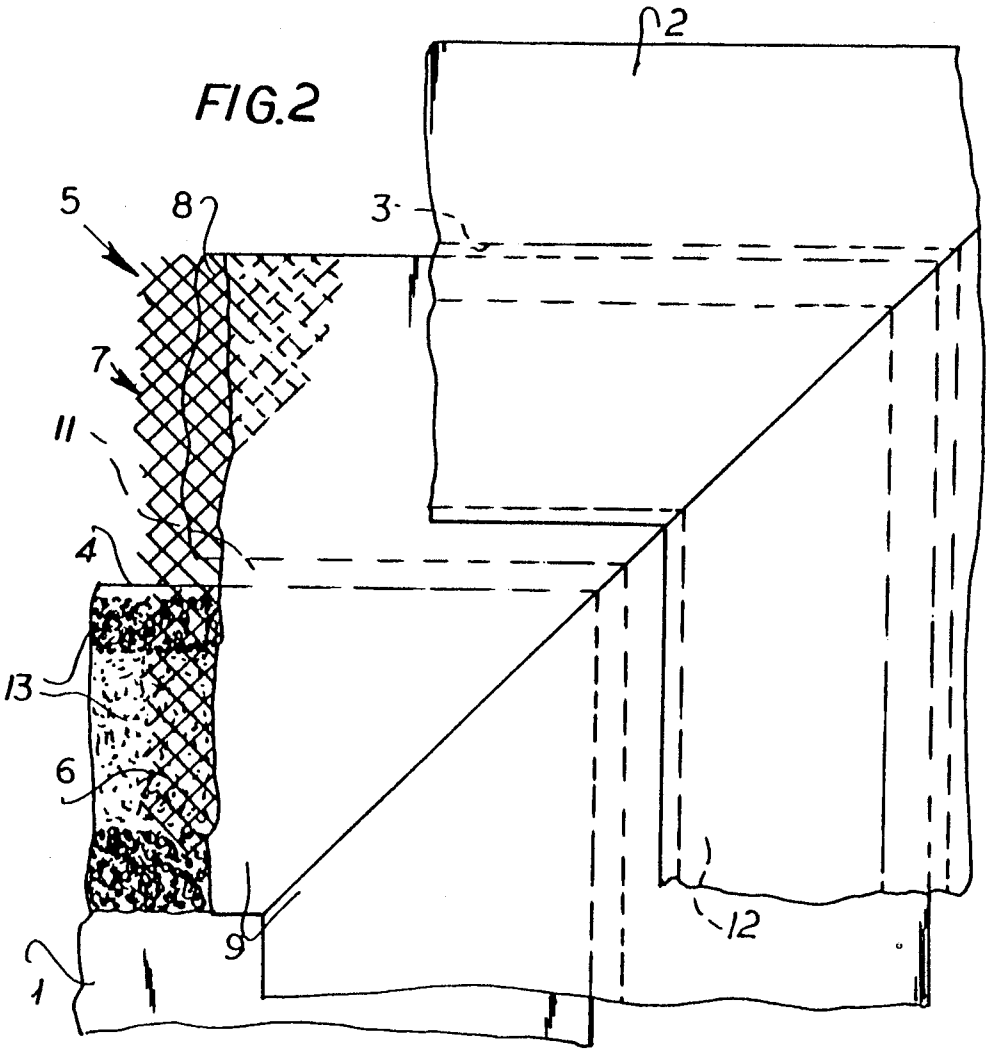
FIG. 2 is a partly cut-away side view of the assembly.
Figure 1:
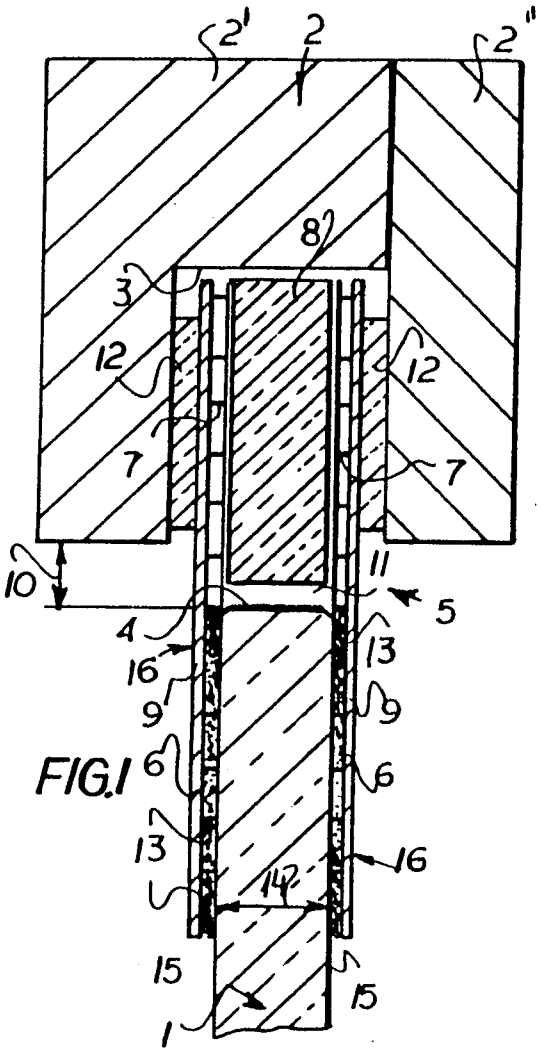
FIG. 1 is a cross section through an assembly according to this invention.

As seen in FIGS. 1 and 2 a planar borosilicate or aluminosilicate glass pane 1 has a pair of opposite faces 15 and an outer edge 4. A frame 2 formed of an L-shaped piece 2' and a bar 2'' forms a groove 3 into which an adapter 5 secured to the outer periphery of the pane 1 fits. The outer edge 4 of the pane 4 is spaced outward by a spacing 10 from the frame 2.

The adapter according to this invention consists of strips 16 having inner portions 6 overlying the respective faces 15 of the pane 1 and outer portions 7 projecting past the edge 4 into the groove 3. According to this invention each strip 16 is formed of expanded metal or a mesh and is protected by a decorative and imperforate cover strip 9.

In the groove 3 between the inner portions 7 is a calcium-silicate bar 8 and a heat-resistant and insulating compound layer 12 is provided between the outer face of each inner portion 7 and the confronting flank of the groove 3. The bar 8 is separated by an air gap 11 of a size equal to about half of the thickness 14 of the glass pane 1 from the frame or channel from the outer edge 4 of the pane 1. A silicone- or water-glass-based glue 13 secures the inner portions 6 to the faces 15 of the pane 1 as well as to the cover strips 9 and to the bar 8. Thus the pane 1 is not only solidly held, but the joint is waterproof. Metallic heat-conducting particles can be mixed in the adhesive 13. The adapter 5 can be fitted to the pane 1 before it is itself fitted into the frame 2.

I claim:

1. A fire-proof glass-pane assembly comprising:

a glass pane having a pair of opposite faces and an outer edge;

a metallic structural channel forming a groove;

a fire-resistant adapter comprising respective metallic edge strips each having an inner portion overlying a respective face of the pane and an outer portion projecting outwardly therepast and into the groove, the outer edge of the pane being spaced from the channel and lying wholly outside the groove, an adhesive securing the inner portions to the respective faces of the pane, and a nonmetallic heat-resistant bar secured between the outer portions of the edge strips and engaged in the groove; and respective layers of insulation lying between the outer portions of the strips and confronting faces of the groove.

2. The assembly defined in claim 1 wherein the strips each include a perforate under strip secured to the respective glass face by the means and an imperforate cover strip adhered over the under strip.

3. The assembly defined in claim 1 wherein the bar has an inner edge lying outside the groove.

4. The assembly defined in claim 3 wherein the outer edge of the pane and inner edge of the bar are spaced apart and separated by an air gap.

5. The assembly defined in claim 1 wherein the strips are of steel.

6. The assembly defined in claim 1 wherein the strips are of expanded metal.

7. The assembly defined in claim 1 wherein the strips have surfaces turned toward the respective faces of the pane and provided with projections holding them off the faces, the adhesive filling interstices between the projections.

8. The assembly defined in claim 1 wherein the strips are of wire mesh.

9. The assembly defined in claim 1 wherein the strips are of metal and less than 1 mm thick.

10. The assembly defined in claim 1 wherein the glass pane is a single-sheet safety glass, a borosilicate glass, or an aluminosilicate glass.

11. The assembly defined in claim 1 wherein the bar is of calcium silicate.

* * * * *